US005686235A

United States Patent [19]

Lau et al.

[11] Patent Number: 5,686,235

[45] Date of Patent: Nov. 11, 1997

[54] PHOTOGRAPHIC ELEMENTS CONTAINING CYAN DYE-FORMING COUPLER HAVING A SULFONE BALLAST GROUP

[75] Inventors: Philip T. S. Lau; Stanley Wray Cowan; Louis Joseph Rossi, all of Rochester, N.Y.

[73] Assignee: Eastman Kodak Company, Rochester, N.Y.

[21] Appl. No.: 700,248

[22] Filed: Aug. 20, 1996

[51] Int. Cl.[6] ..... G03C 1/08; G03C 7/26; G03C 7/32

[52] U.S. Cl. ..... 430/553; 430/552; 430/385

[58] Field of Search ..... 430/552, 553, 430/385

[56] References Cited

U.S. PATENT DOCUMENTS

| | | | |
|---|---|---|---|
| 4,609,619 | 9/1986 | Katoh et al. | 430/553 |
| 4,775,616 | 10/1988 | Kilminster et al. | 430/552 |
| 4,849,328 | 7/1989 | Hoke et al. | 430/553 |
| 5,008,180 | 4/1991 | Merkel et al. | 430/552 |
| 5,045,442 | 9/1991 | Hoke | 430/553 |
| 5,183,729 | 2/1993 | Naito et al. | 430/385 |
| 5,378,596 | 1/1995 | Naruse et al. | 430/552 |

FOREIGN PATENT DOCUMENTS

| | | |
|---|---|---|
| 206338 | 8/1989 | Japan . |
| 1253742 | 10/1989 | Japan . |
| 2035450 | 2/1990 | Japan . |
| 4163448 | 6/1992 | Japan . |
| 213453 | 8/1992 | Japan . |
| 142690 | 6/1993 | Japan . |

*Primary Examiner*—Geraldine Letscher
*Attorney, Agent, or Firm*—Arthur E. Kluegel

[57] ABSTRACT

A photographic element comprises a light sensitive silver halide emulsion layer having associated therewith a cyan dye forming coupler having Formula (I):

(I)

wherein $R_1$ represents hydrogen or an alkyl group;

$R_2$ represents an alkyl group or an aryl group;

n represents 1, 2, or 3;

each X is located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent.

The element forms a dye upon development which has a desirably low wavelength of maximum absorbance and low unwanted green absorbance.

17 Claims, 2 Drawing Sheets

PHOTOGRAPHIC ELEMENTS CONTAINING CYAN DYE-FORMING COUPLER HAVING A SULFONE BALLAST GROUP

FIELD OF THE INVENTION

The present invention relates to a color photographic element containing a phenolic cyan coupler having a specific sulfone ballast group.

BACKGROUND OF THE INVENTION

A typical photographic element contains multiple layers of light-sensitive photographic silver halide emulsions with one or more of these layers being spectrally sensitized to each of blue light, green light and red light. The blue, green and red light-sensitive layers typically contain yellow, magenta, and cyan dye-forming couplers, respectively.

For forming color photographic images, the color photographic material is exposed imagewise and processed in a color developer bath containing an aromatic primary amine color developing agent. Image dyes are formed by the coupling reaction of these couplers with the oxidized product of the color developing agent.

Generally, image couplers are selected according to their ability to couple efficiently with oxidized color developer, thus minimizing the necessary amounts of coupler and silver halide emulsion in the photographic element; to provide image dyes whose hues are appropriate for the particular photographic application in which they are used; to provide image dyes whose absorption spectra have low unwanted side absorptions and thus lead to good color reproduction; to provide image dyes with good stability to heat, light, and ferrous ions which are present in the bleaching solution; and to provide good physical and chemical properties such as good solubility in coupler solvents, and good dispersibility in gelatin.

In recent years, a great deal of study has been conducted to improve dye-forming couplers for silver halide photosensitive materials in terms of improved color reproducibility and image dye stability. However, further improvements are needed, particularly in the area of cyan couplers.

The couplers used to form cyan image dyes are generally derived from naphthols and phenols, as described, for example, in U.S. Pat. Nos. 2,367,351, 2,423,730, 2,474,293, 2,772,161, 2,772,162, 2,895,826, 2,920,961, 3,002,836, 3,466,622, 3,476,563, 3,552,962, 3,758,308, 3,779,763, 3,839,044, 3,880,661, 3,998,642, 4,333,999, 4,990,436, 4,960,685, and 5,476,757; in French patents 1,478,188 and 1,479,043; and in British patent 2,070,000. These types of couplers can be used either by being incorporated in the photographic silver halide emulsion layers or externally in the processing baths. In the former case the couplers must have ballast substituents built into the molecule to prevent the couplers from migrating from one layer into another. Although these couplers have been used extensively in color photographic film and paper products, the dyes derived from them still suffer from poor stability to heat, humidity or light, low coupling efficiency or optical density, and in particular from undesirable blue and green absorptions which cause considerable reduction in color reproduction and color saturation.

The hue of a dye is a function of both the shape and the position of its spectral absorption band. Traditionally, the cyan dyes used in color photographic papers have had nearly symmetrical absorption bands centered in the region of 620 to 680 nm, preferably 630 to 660 nm, and more preferably 635 to 655 nm. Such dyes have rather large amounts of unwanted absorption in the green and blue regions of the spectrum.

More desirable would be a dye whose absorption band is asymmetrical in nature and biased towards the green region, that is, with a steep slope on the short wavelength side. Such a dye would suitably peak at a shorter wavelength than a dye with symmetrical absorption band, but the exact position of the desired peak depends on several factors including the degree of asymmetry and the shapes and positions of the absorption bands of the magenta and yellow dyes with which it is associated.

Cyan couplers which have been recently proposed to overcome some of these problems are 2,5-diacylaminophenols containing a sulfone, sulfonamido or sulfate moiety in the ballasts at the 5-position, as disclosed in U.S. Pat. Nos. 4,609,619, 4,775,616, 4,849,328, 5,008,180, 5,045,442, and 5,183,729; and Japanese patent applications JP02035450 A2, JP01253742 A2, JP04163448 A2, JP04212152 A2, and JP05204110 A2. Even though cyan image dyes formed from these couplers show improved stability to heat and humidity, enhanced optical density and resistance to reduction by ferrous ions in the bleach bath, the dye absorption maxima (λmax) are too bathochromically shifted (that is, shifted to the red end of the visible spectrum) and the absorption spectra are too broad with considerable amounts of undesirable blue and green absorptions. Thus, these couplers are not practical for use in color papers.

Although the use of sulfone (—$SO_2$—) groups in the ballast moieties of phenolic cyan couplers has been described in various publications cited above, the coupler structures disclosed therein do not possess the combination of essential moieties in the ballasts that can provide the desired reduction in unwanted green and blue absorption, which would result in improved color reproduction and color saturation in color photographic papers.

Accordingly, there has been a need to provide a photographic element containing cyan dye-forming couplers which do not have the inherent disadvantages of the known couplers. It is therefore an object of this invention to provide a cyan dye-forming coupler which exhibits excellent photographic properties such as coupling efficiency, and whose dye has excellent stability to heat and light and exhibits improved color reproduction and saturation.

SUMMARY OF THE INVENTION

A photographic element comprises a light sensitive silver halide emulsion layer having associated therewith a cyan dye forming coupler having Formula (I):

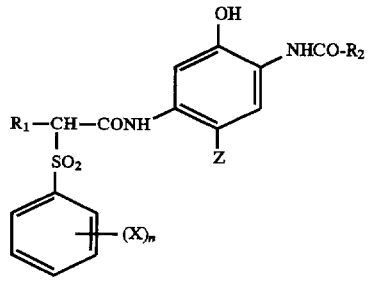

(I)

wherein $R_1$ represents hydrogen or an alkyl group;

$R_2$ represents an alkyl group or an aryl group;

n represents 1, 2, or 3;

each X is located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent.

The element forms a dye upon development which has improved color reproduction and saturation.

Figure 1:
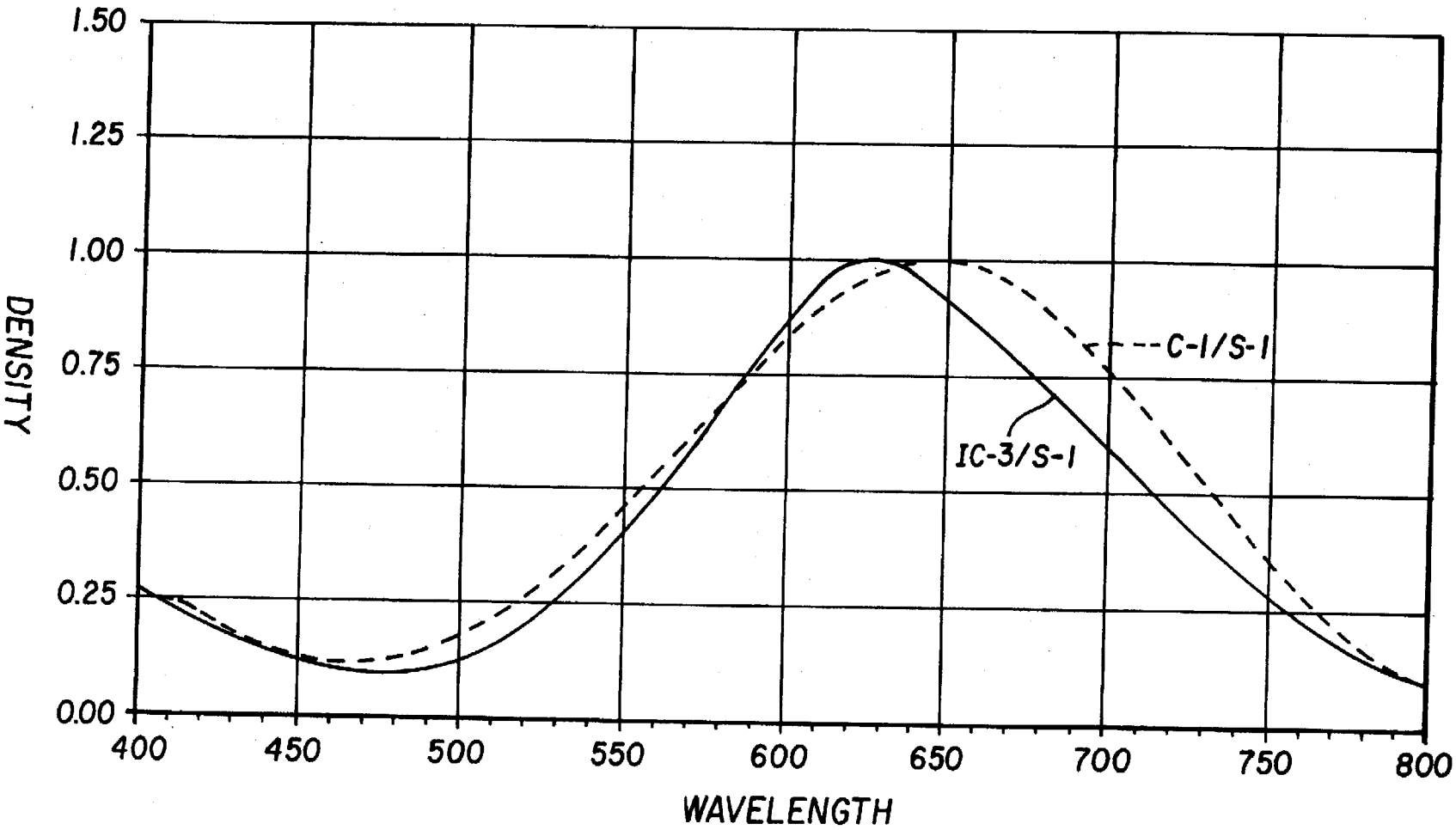
FIG. 1 shows the absorption spectra of the image dyes from couplers IC-3 (solid line) and C-1 (broken line), both dispersed in solvent S-1.

Both drawings illustrate the lower unwanted green and blue absorption of the inventive elements.

DETAILED DESCRIPTION OF THE INVENTION

The Summary of the Invention describes a photographic element containing a cyan dye-forming coupler which upon processing in the conventional manner forms in the exposed areas, a cyan dye whose absorption spectrum is hypsochromically shifted (that is, shifted toward the blue end of the spectrum) and sharp-cutting on its short wavelength side. The former is particularly necessary for prints obtained in accordance with conventional printing processes, and the latter improves color reproduction and provides high color saturation.

The coupler of the invention is a 2,5-diacylaminophenol cyan coupler in which the 5-acylamino moiety is an amide of a carboxylic acid which is substituted in the alpha position by a particular sulfone (—$SO_2$—) group. The sulfone moiety must be an arylsulfone and cannot be an alkylsulfone, and must be substituted only at the meta or para position of the aryl ring. In addition, the 2-acylamino moiety must be an amide (—NHCO—) of a carboxylic acid, and cannot be a ureido (—NHCONH—) group. The result of this unique combination of sulfone-containing amide group at the 5-position and amide group at the 2-position is a class of cyan dye-forming couplers which form H-aggregated image dyes having very sharp-cutting dye hues on the short wavelength side of the absorption curves and absorption maxima ($\lambda$max) generally in the range of 620–645 nanometers, which is ideally suited for producing excellent color reproduction and high color saturation in color photographic papers.

Referring to formula (I), $R_1$ represents hydrogen or an alkyl group including linear or branched cyclic or acyclic alkyl group of 1 to 10 carbon atoms, suitably a methyl, ethyl, n-propyl, isopropyl or butyl group, and most suitably an ethyl group.

$R_2$ represents an aryl group or an alkyl group such as a perfluoroalkyl group. Such alkyl groups typically have 1 to 20 carbon atoms, usually 1 to 4 carbon atoms, and include groups such as methyl, propyl and dodecyl,; a perfluoroalkyl group having 1 to 20 carbon atoms, typically 3 to 8 carbon atoms, such as trifluoromethyl or perfluorotetradecyl, heptafluoropropyl or heptadecylfluorooctyl; a substituted or unsubstituted aryl group typically having 6 to 30 carbon atoms, which may be substituted by, for example, 1 to 4 halogen atoms, a cyano group, a carbonyl group, a carbonamido group, a sulfonamido group, a carboxy group, a sulfo group, an alkyl group, an aryl group, an alkoxy group, an aryloxy group, an alkylthio group, an arylthio group, an alkylsulfonyl group or an arylsulfonyl group. Suitably, $R_2$ represents a heptafluoropropyl group, a 4-chlorophenyl group, a 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, or an alkylsulfonylphenyl group.

In formula (I), each X is located at the meta or para position of the phenyl ring, and each independently represents a linear or branched, saturated or unsaturated alkyl or alkenyl group such as methyl, t-butyl, dodecyl, pentadecyl or octadecyl; an alkoxy group such as methoxy, t-butoxy or tetradecyloxy; an aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such as methanesulfonamido, 4-chlorophenylsulfonamido or hexadecanesulfonamido; a ureido group such as methylureido or phenylureido; an alkoxycarbonyl or aryloxycarbonylamino group such as methoxycarbonylamino or phenoxycarbonylamo; a carbamoyl group such as N-butylcarbamoyl or N-methyl-N-dodecylcarbamoyl; or a perfluoroalkyl group such as trifluoromethyl or heptafluoropropyl. Suitably X represents the above groups having 1 to 30 carbon atoms, more preferably 8 to 20 linear carbon atoms. Most typically, X represents a linear alkyl group of 12 to 18 carbon atoms such as dodecyl, pentadecyl or octadecyl.

"n" represents 1, 2, or 3; if n is 2 or 3, then the substituents X may be the same or different.

Z represents a hydrogen atom or a group which can be split off by the reaction of the coupler with an oxidized color developing agent, known in the photographic art as a "coupling-off group." The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169, 3,227,551, 3,432,521, 3,467,563, 3,617,291, 3,880,661, 4,052,212, and 4,134,766; and in U.K. Patent Nos. and published applications 1,466,728, 1,531,927, 1,533,039, 2,066,755A, and 2,017,704A, the disclosures of which are incorporated herein by reference. Halogen, alkoxy and aryloxy groups are most suitable.

Examples of specific coupling-off groups are —Cl, —F, —Br, —SCN, —$OCH_3$, —$OC_6H_5$, —$OCH_2C(=O)$ $NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

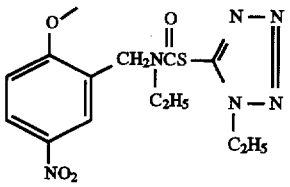

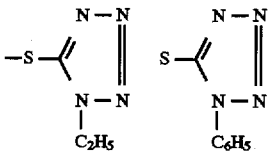

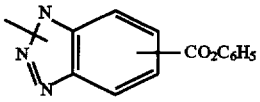

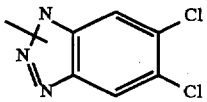

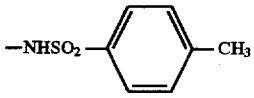

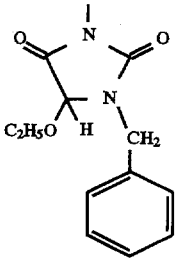

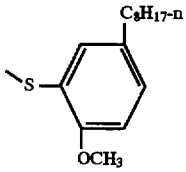

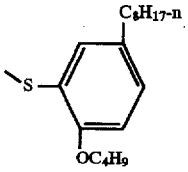

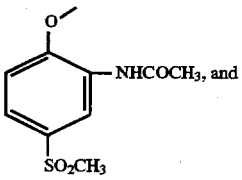

-continued

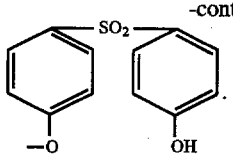

Typically, the coupling-off group is a chlorine atom.

It is essential that the substituent groups $R_1$, $R_2$, X, and Z be selected so as to adequately ballast the coupler and the resulting dye in the organic solvent in which the coupler is dispersed. The ballasting may be accomplished by providing hydrophobic substituent groups in one or more of the substituent groups $R_1$, $R_2$, X, and Z. Generally a ballast group is an organic radical of such size and configuration as to confer on the coupler molecule sufficient bulk and aqueous insolubility as to render the coupler substantially non-diffusible from the layer in which it is coated in a photographic element. Thus the combination of substituent groups $R_1$, $R_2$, X, and Z in formula (I) are suitably chosen to meet these criteria. To be effective, the ballast must contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group. Therefore, in these embodiments the ballast would be primarily located as part of groups $R_2$, X, and Z. Furthermore, even if the coupling-off group Z contains a ballast it is often necessary to ballast the other substituents as well, since Z is eliminated from the molecule upon coupling; thus, the ballast is most advantageously provided as part of groups $R_2$ and X.

The following examples further illustrate the invention. It is not to be construed that the present invention is limited to these examples.

IC-1

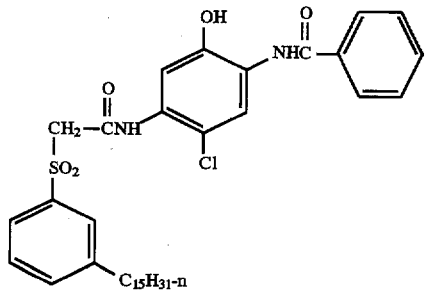

IC-2

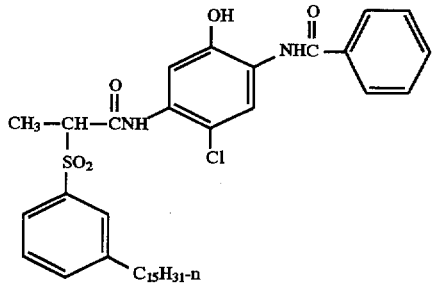

-continued
IC-3
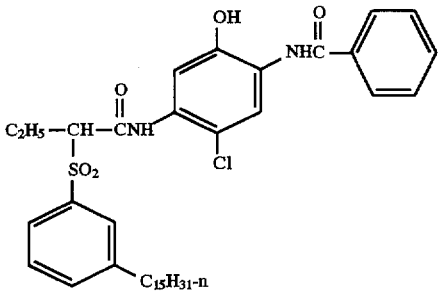
IC-4
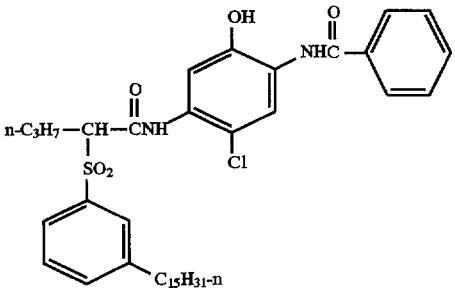
IC-5
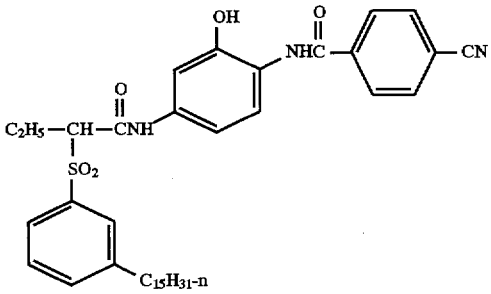
IC-6
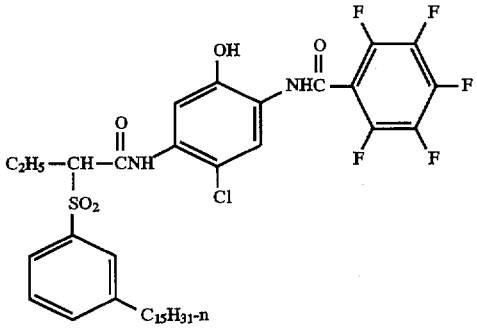
IC-7
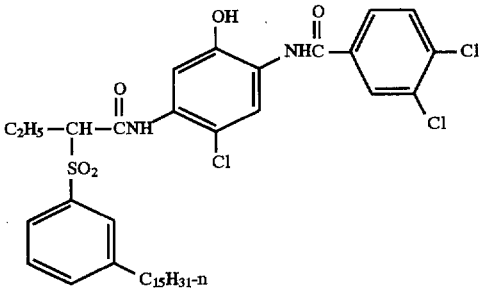
-continued
IC-8
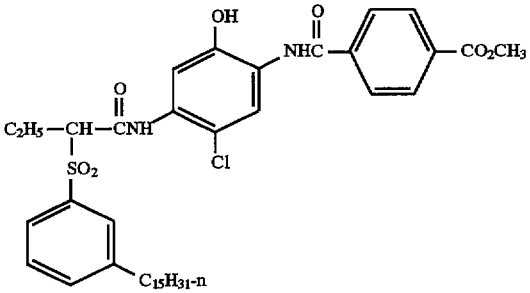
IC-9
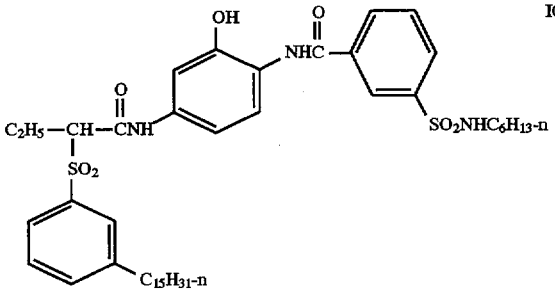
IC-10
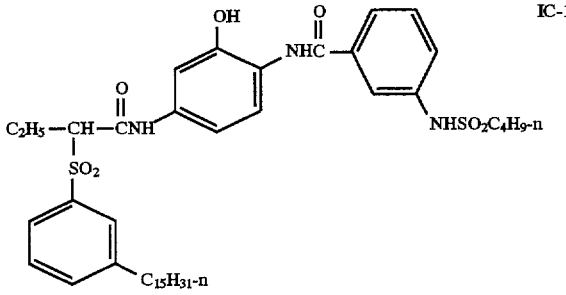
IC-11
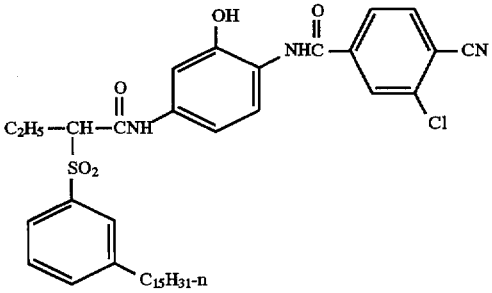
IC-12
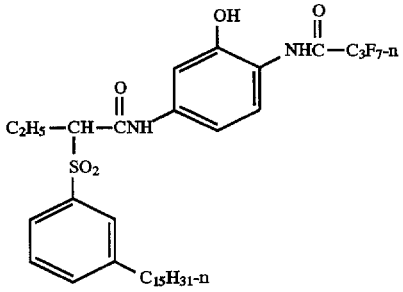

-continued
IC-13
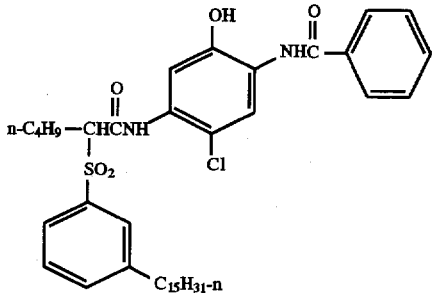
IC-14
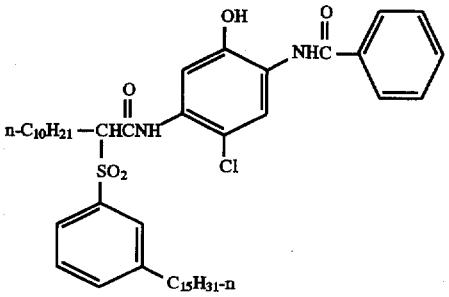
IC-15
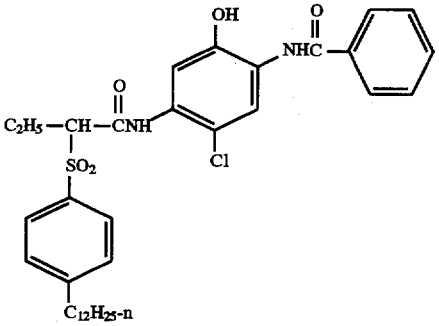
IC-16
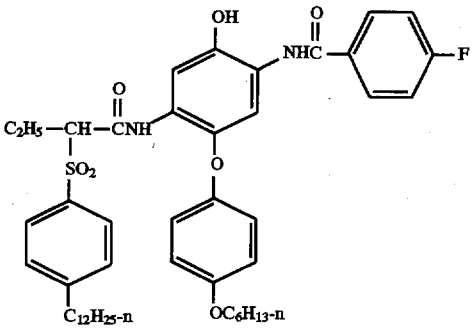
IC-17
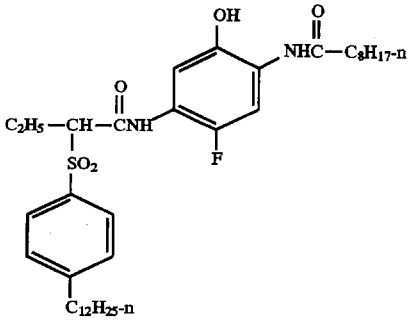
-continued
IC-18
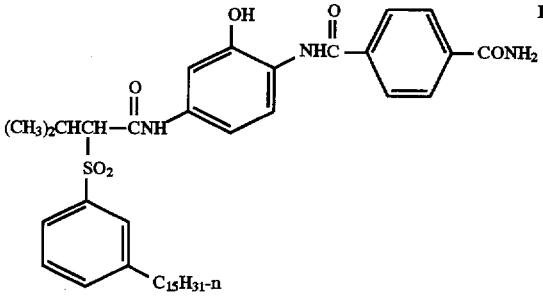
IC-19
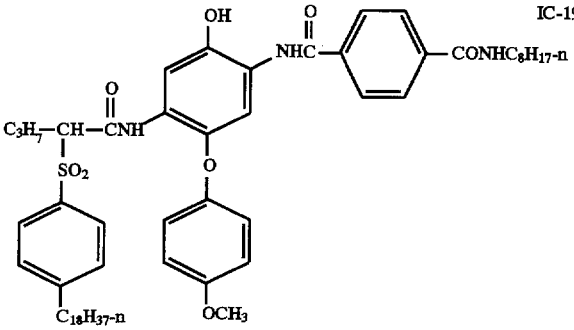
IC-20
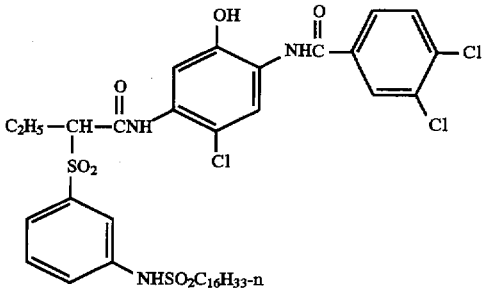
IC-21
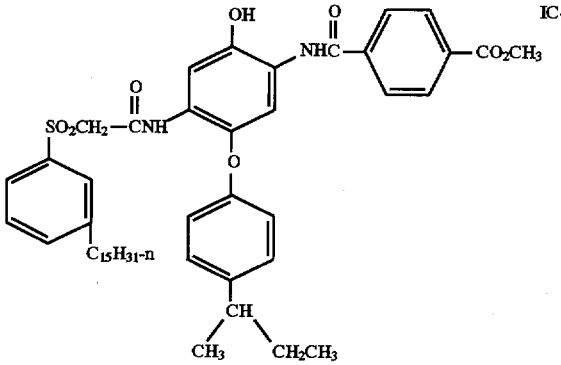
IC-22
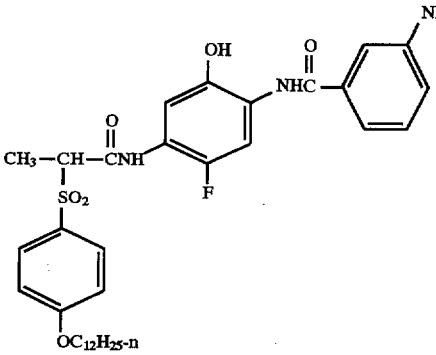

-continued
IC-23
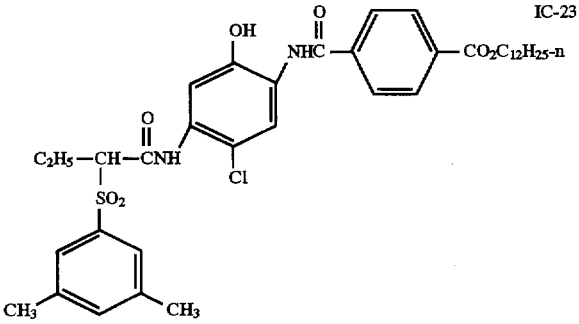
IC-24
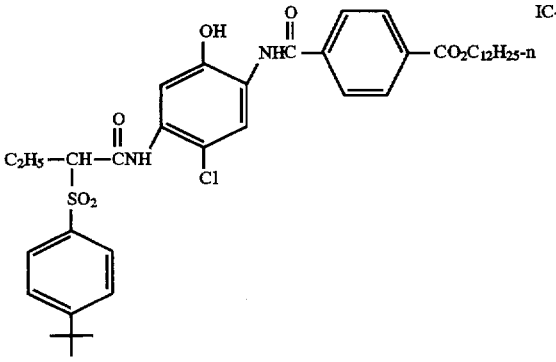
IC-25
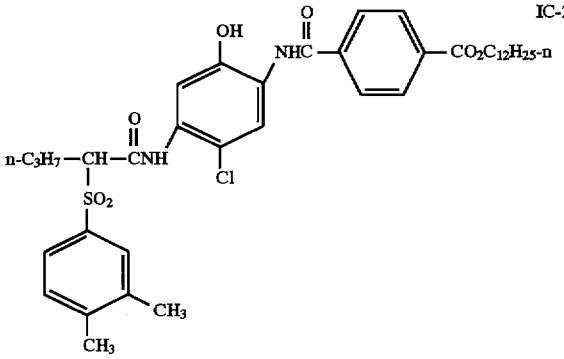
IC-27
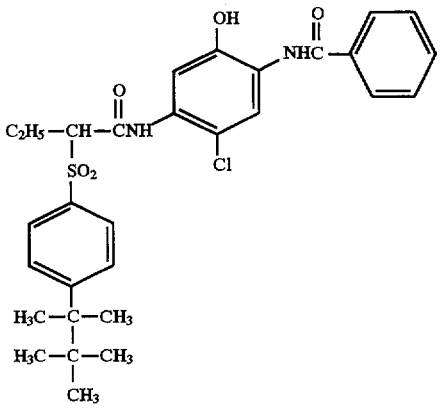
-continued
IC-28
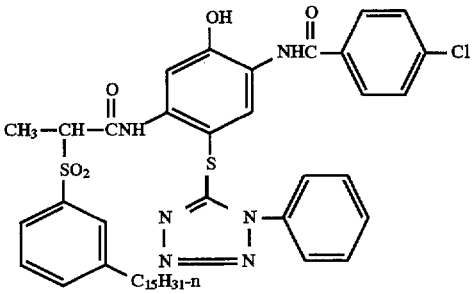
IC-29
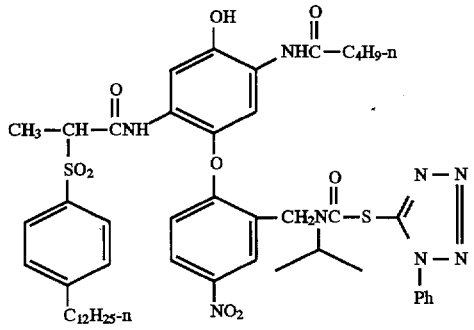
IC-30
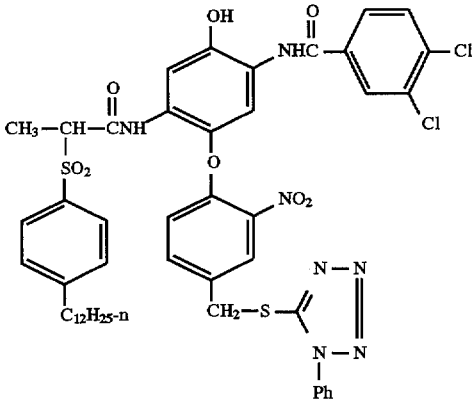
IC-31
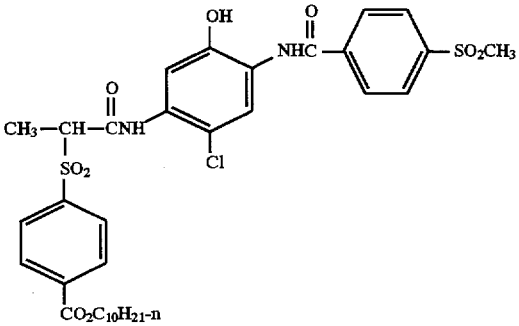

-continued

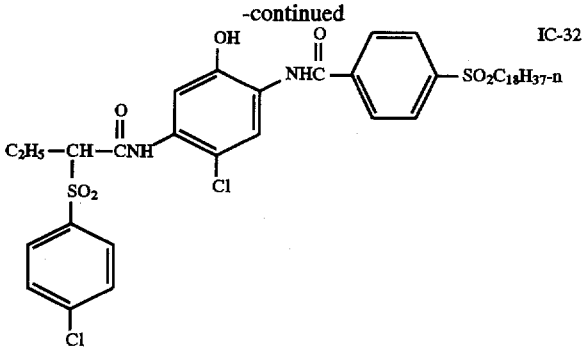

IC-32

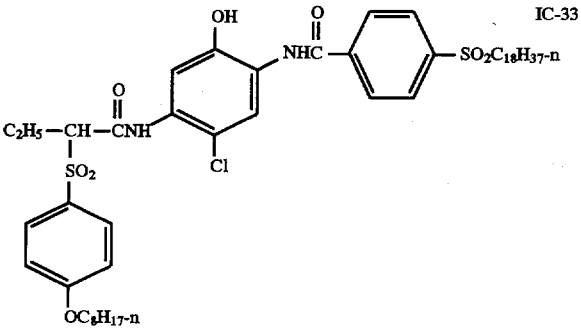

IC-33

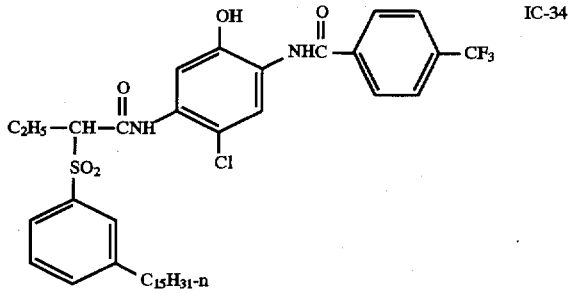

IC-34

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di- t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di -t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing)provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Cyan image dye-forming couplers may be included in the element besides the coupler of the invention. These couplers may be located in the same layer as the coupler of the invention or in a different layer.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859, 578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384, 657; 3,379,529; 3,615,506; 3,617,291; 3,620,746; 3,701, 783; 3,733,201; 4,049,455; 4,095,984; 4,126,459; 4,149, 886; 4,150,228; 4,211,562; 4,248,962; 4,259,437; 4,362, 878; 4,409,323; 4,477,563; 4,782,012; 4,962,018; 4,500, 634; 4,579,816; 4,607,004; 4,618,571; 4,678,739; 4,746, 600; 4,746,601; 4,791,049; 4,857,447; 4,865,959; 4,880, 342; 4,886,736; 4,937,179; 4,946,767; 4,948,716; 4,952, 485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 72,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated hereinby reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

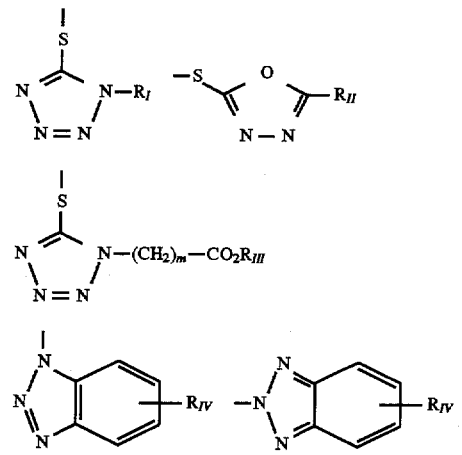

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

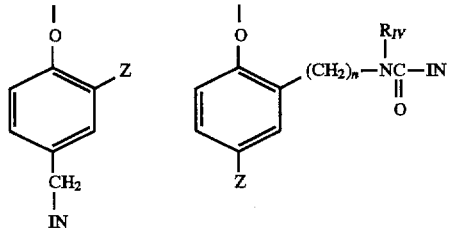

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

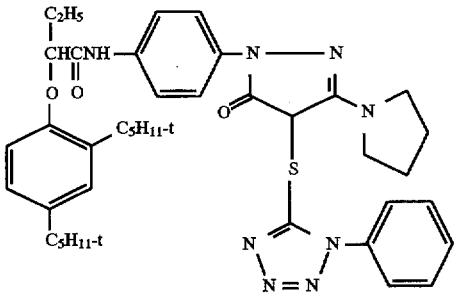

D2

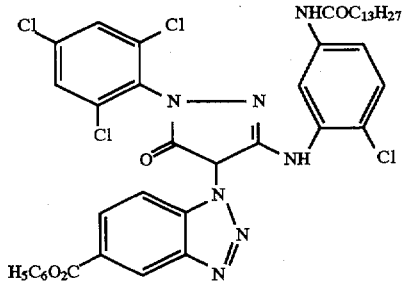

-continued

D3

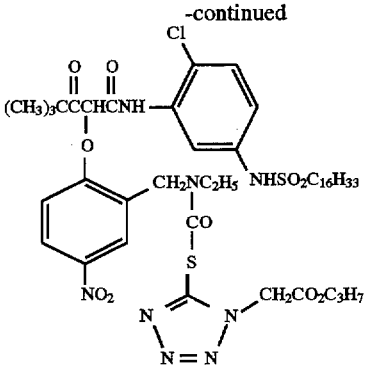

D4

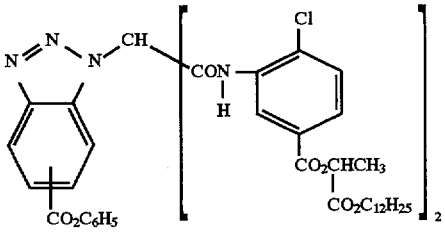

D5

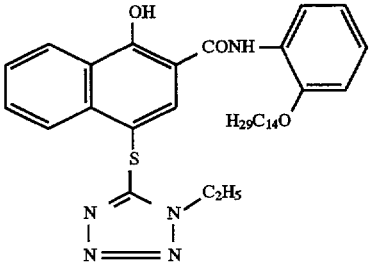

D6

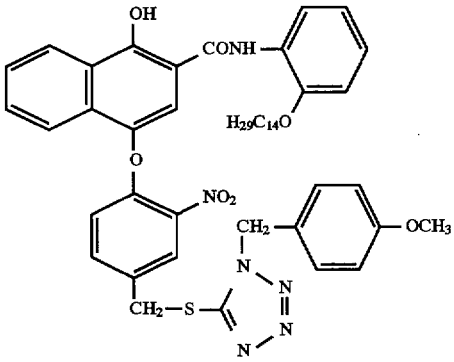

D7

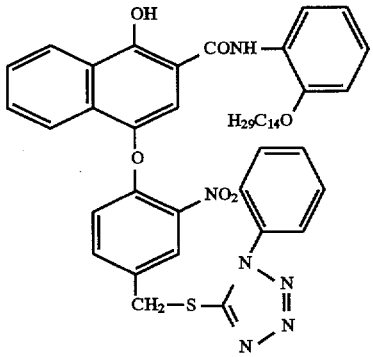

-continued

D8

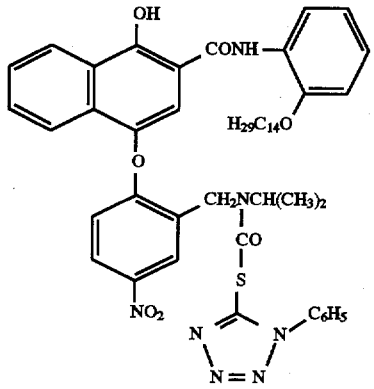

D9

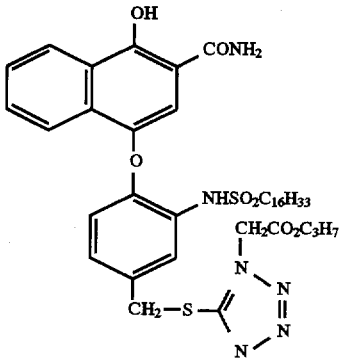

D10

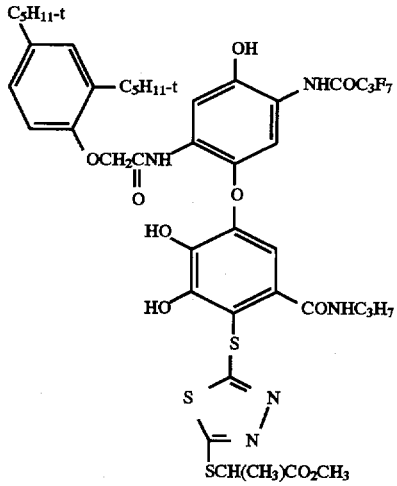

D11

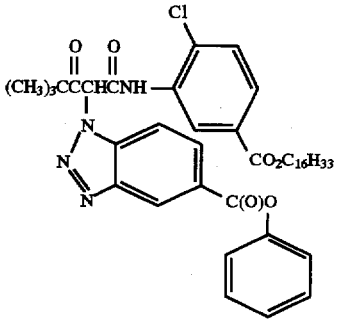

-continued

D12

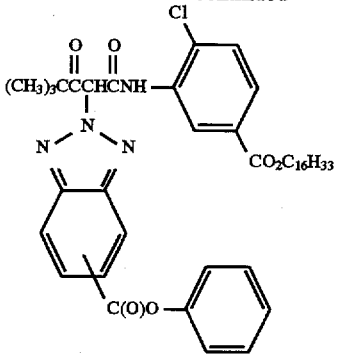

It is also contemplated that the concepts of the present invention may be employed to obtain reflection. color prints as described in *Research Disclosure*, November 1979, Item 18716, available from Kenneth Mason Publications, Ltd, Dudley Annex, 12a North Street, Emsworth, Hampshire P0101 7DQ, England, incorporated hereinby reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl -N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS EXAMPLES

The cyan couplers of this invention can be prepared by reacting alkyl or aryl acid chlorides with an appropriate aminophenol, such as 2-amino-5-nitrophenol or 2-amino-4-chloro-5-nitrophenol to form the 2-carbonamido coupler intermediates. The nitro group of the coupler intermediate can then be reduced and a separately prepared sulfone-containing ballast can be attached thereto by conventional procedures. The synthesis of coupler compound IC-3 will further illustrate the invention.

A. Preparation of the phenolic coupler intermediate

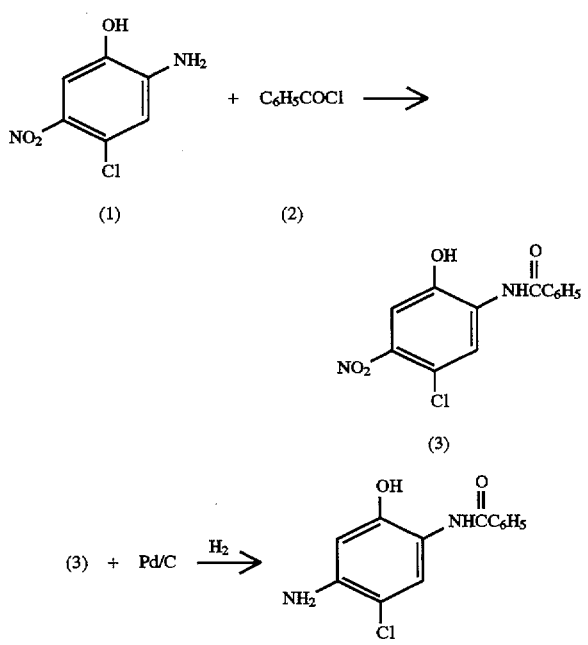

To a stirred solution of 37.7 g (0.20 mol) of 2-amino-4-chloro-5-nitrophenol (1) and 48.5 g (0.40 mol) of N,N-dimethylaniline in 500 ml THF was added 30.9 g (0.22 mol) of benzoyl chloride (2). After stirring for 3 hours at room temperature, the reaction mixture was drowned in ice water and 20 ml concentrated HCl. The solid which precipitated out was collected, washed with water, and recrystallized from $CH_3CN$ to give 54.6 g of the nitro compound (3).

A solution of 8.8 g (0.03 mol) of (3) in 150 ml THF was heated with a teaspoonful of 10% Pd/C and hydrogenated at room temperature under 50 lb per square inch hydrogen pressure for 3 hours. The catalyst was filtered off to give the reduced aminophenol (4) which was stored under a blanket of nitrogen while the sulfone-containing ballast was being prepared.

B. Preparation of the ballast acid chloride

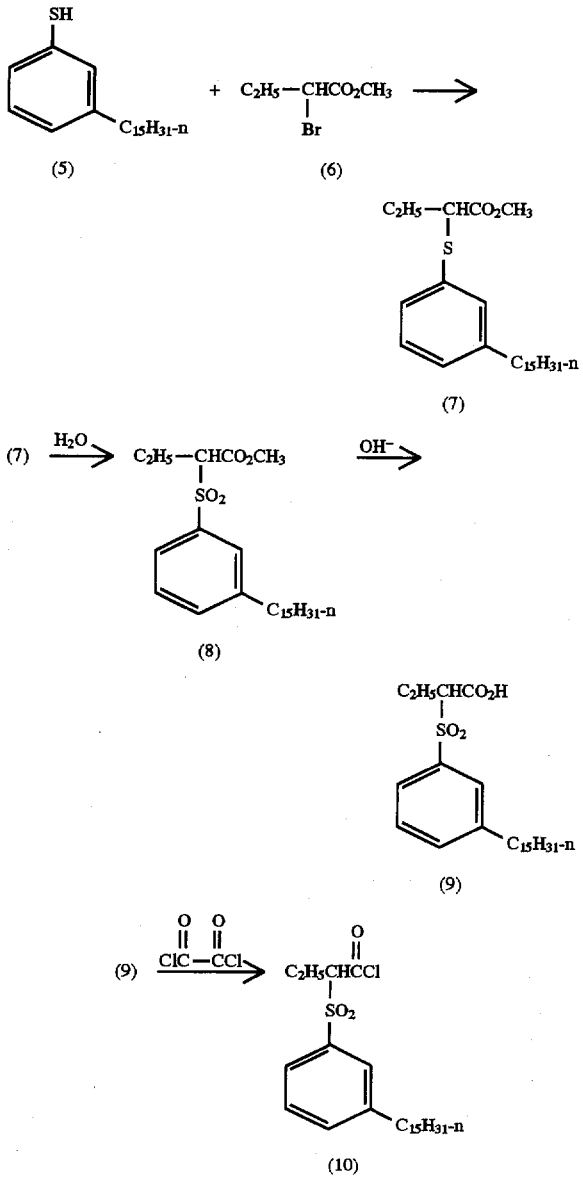

To a well-stirred solution of 40 g (0.13 mol) m-pentadecylphenylthiol (5) and 27 g (0.15 mol) of methyl a-bromobutyrate (6) in 500 ml acetone was added 104 g (0.75 mol) $K_2CO_3$. The mixture was heated on a steam bath and refluxed for 1 hour. After cooling to room temperature the insolubles were filtered off. The filtrate was poured into water and extracted with ethyl acetate. The ethyl acetate was removed under reduced pressure and the residual crude product mixture was dissolved in ligroin. The solution was chromatographed through a short silica gel column, eluting first with ligroin and finally with 50% ligroin-$CH_2Cl_2$ mixture. The fractions containing the pure product were combined and the solvent was removed to give 43 g of (7) as a colorless oil.

The ballast intermediate (7) was taken up in 300 ml acetic acid, cooled to 10°–15° C., and treated with 23 ml 30% $H_2O_2$. The mixture was stirred at room temperature for 0.5 hour and then heated on the steam bath for another hour. Upon standing at room temperature overnight the product crystallized out. The pure white solid crystals were collected to give 41.5 g of (8).

The sulfone ballast ester (8) was dissolved in 200 ml $CH_3OH$ and 200 ml THF. The solution was then heated with 18 g NaOH dissolved in 150 ml water. After stirring at room temperature for 1 hour, the mixture was poured into dilute HCl. The white solid that precipitated out was collected, washed with water and dried to give 40 g of the sulfone ballast acid (IX) as a white solid.

To a solution of 13.6 g (0.031 mol) of (9) in 100 ml $CH_2Cl_2$ was added with stirring 11.4 g (0.09 mol) oxalyl chloride and 5 drops of DMF. After stirring at room temperature for 2 hours, the mixture was concentrated to give 13.9 g of ballast acid chloride (10) as an oil.

C. Preparation of coupler compound IC-3

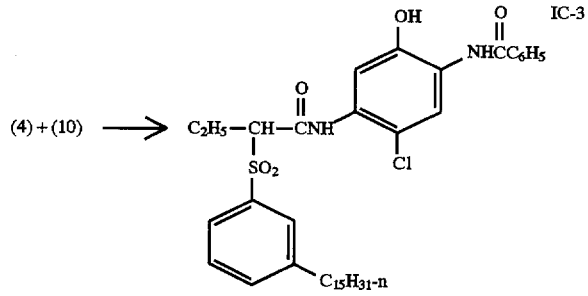

To a stirred solution of 7.9 g (0.03 mol) of the aminophenol (4) in 150 ml THF was added 7.3 g (0.06 mol) of N,N-dimethylaniline and 13.9 g (0.03 mol) of the ballast acid chloride (10). After stirring at room temperature for 2 hours the reaction mixture was poured into water containing 5 ml concentrated HCl. The tan colored solid was collected, washed with water, and recrystallized from $CH_3CN$ to give 17.4 g (85%) of crystalline white solid (IC-3). The structure was confirmed by $H^1$ NMR and elemental analysis.

Calcd. for $C_{38}H_{51}C_1N_2O_5S$: C, 66.79; H, 7.52; N, 4.10

Found: C, 66.61; H, 7.56; N, 4.02

Preparation of Photographic Elements

On a gel-subbed, polyethylene-coated paper support were coated the following layers:

First Layer

An underlayer containing 3.23 grams gelatin per square meter.

Second Layer

A photosensitive layer containing (per square meter) 2.15 grams gelatin, an amount of red-sensitized silver chloride emulsion containing the amount of silver (determined by the equivalency of the coupler) indicated in Table 1, 2, or 3; a dispersion containing $8.61\times10^{-4}$ mole of the coupler indicated in Table 1, 2, or 3; and 0.043 gram surfactant Alkanol XC (trademark of E. I. Dupont Co.) (in addition to the Alkanol XC used to prepare the coupler dispersion). The coupler dispersion contained the coupler, all of the gelatin in the layer except that supplied by the emulsion, an amount of the coupler solvent indicated in Table 1, 2, or 3 equal to the weight of coupler, and 0.22 gram Alkanol XC.

Third Layer

A protective layer containing (per square meter) 1.40 grams gelatin, 0.15 gram bis(vinylsulfonyl)methane, 0.043 gram Alkanol XC, and $4.40\times10^{-6}$ gram tetraethylammonium perfluorooctanesulfonate.

The coupler solvents used were:

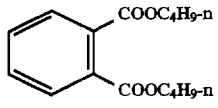

S-1

$CH_3(CH_2)_7CH{=}CH(CH_2)_8OH$ S-2

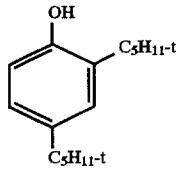

S-3

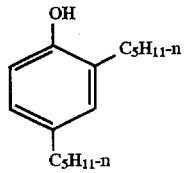

S-4

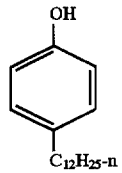

S-5

The comparison couplers used were:

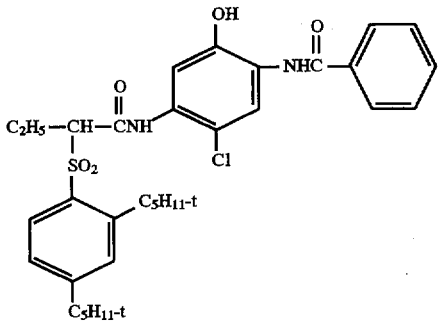

C-1

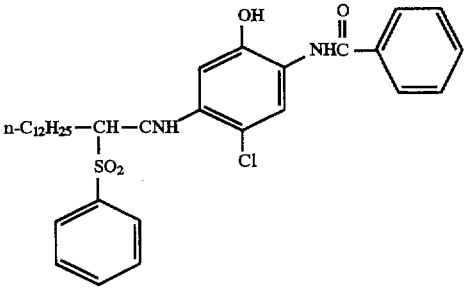

C-2

-continued

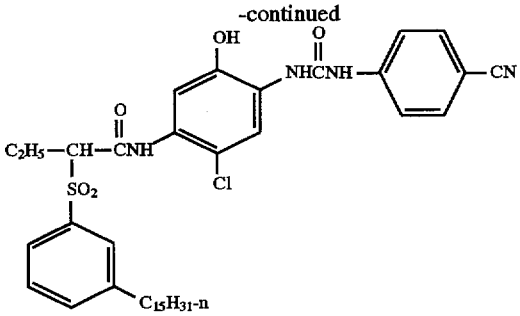

C-3

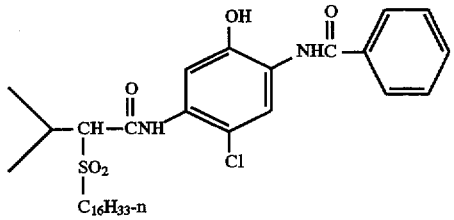

C-4

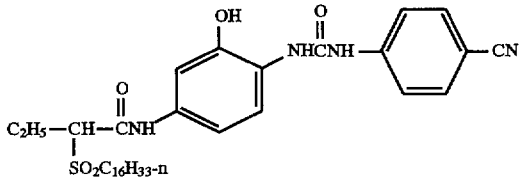

C-5

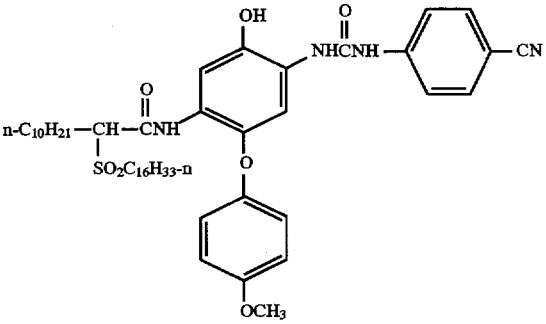

C-6

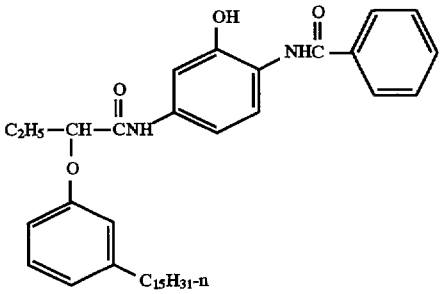

C-7

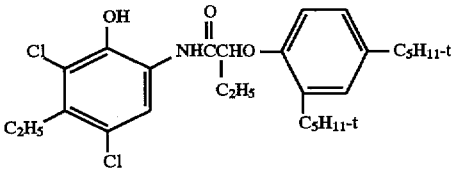

C-8

Comparison couplers C-1 through C-6 are closely related to the couplers of the present invention; they all contain sulfone ballasts, but they do not satisfy the structural requirements of the invention in other respects. Comparison coupler C-7 is similar to coupler IC-2 of the invention except that is has an oxygen atom replacing the sulfonyl group in the ballast. Comparison coupler C-8 is a phenolic coupler not closely related to the couplers of the invention, but is one included because it is currently used in many commercially available color photographic papers.

Preparation of Processed Photographic Examples

Processed samples were prepared by exposing the coatings through a step wedge and processing as follows:

| Process Step | Time (min.) | Temp. (C.) |
|---|---|---|
| Developer | 0.75 | 35.0 |
| Bleach-Fix | 0.75 | 35.0 |
| Water wash | 1.50 | 35.0 |

The processing solutions used in the above process had the following compositions (amounts per liter of solution):

| Developer | |
|---|---|
| Triethanolamine | 12.41 g |
| Blankophor REU (trademark of Mobay Corp.) | 2.30 g |
| Lithium polystyrene sulfonate | 0.09 g |
| N,N-Diethylhydroxylamine | 4.59 g |
| Lithium sulfate | 2.70 g |
| Developing agent Dev-1 | 5.00 g |
| 1-Hydroxyethyl-1,1-diphosphonic acid | 0.49 g |
| Potassium carbonate, anhydrous | 21.16 g |
| Potassium chloride | 1.60 g |
| Potassium bromide | 7.00 mg |
| pH adjusted to 10.4 at 26.7 C. | |
| **Bleach-Fix** | |
| Solution of ammonium thiosulfate | 71.85 g |
| Ammonium sulfite | 5.10 g |
| Sodium metabisulfite | 10.00 g |
| Acetic acid | 10.20 g |
| Ammonium ferric ethylenediaminetetraacetate | 48.58 g |
| Ethylenediaminetetraacetic acid | 3.86 g |
| pH adjusted to 6.7 at 26.7 C. | |

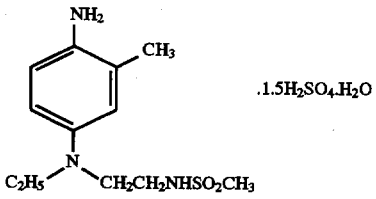

Dev-1

The spectra of the resulting dyes were measured and normalized to a maximum absorption of 1.00. The wavelength of maximum absorption was recorded as the "λmax." As a measure of the sharpness of the curve on the left (short wavelength) side of the absorption band the "left bandwidth" (LBW) was obtained by subtracting the wavelength at the point on the left side of the absorption band where the normalized density is 0.50 from the λmax. A lower value of LBW indicates a reduction in the unwanted green absorption and is thus desirable. The λmax and LBW values are shown in Tables 1, 2 and 3.

TABLE 1

Couplers Dispersed in Solvent S-1

| Comparison or Invention | Coupler | Solvent | g Ag per m² | λmax nm | LBW nm |
|---|---|---|---|---|---|
| Comparison | C-1 | S-1 | 0.19 | 649 | 83 |
| Comparison | C-2 | S-1 | 0.19 | 642 | 77 |
| Comparison | C-3 | S-1 | 0.19 | 683 | 98 |
| Comparison | C-4 | S-1 | 0.19 | 646 | 83 |

TABLE 1-continued

Couplers Dispersed in Solvent S-1

| Comparison or Invention | Coupler | Solvent | g Ag per m² | λmax nm | LBW nm |
|---|---|---|---|---|---|
| Comparison | C-5 | S-1 | 0.39 | 685 | 88 |
| Comparison | C-6 | S-1 | 0.39 | 648 | 85 |
| Comparison | C-7 | S-1 | 0.39 | 641 | 81 |
| Comparison | C-8 | S-1 | 0.19 | 661 | 80 |
| Invention | IC-3 | S-1 | 0.19 | 624 | 53 |
| Invention | IC-5 | S-1 | 0.39 | 624 | 56 |
| Invention | IC-6 | S-1 | 0.19 | 630 | 62 |
| Invention | IC-7 | S-1 | 0.19 | 628 | 51 |
| Invention | IC-8 | S-1 | 0.39 | 626 | 58 |
| Invention | IC-9 | S-1 | 0.39 | 631 | 61 |
| Invention | IC-10 | S-1 | 0.39 | 628 | 61 |
| Invention | IC-15 | S-1 | 0.19 | 635 | 66 |

TABLE 2

Couplers Dispersed in Solvent S-2

| Comparison or Invention | Coupler | Solvent | g Ag per m² | λmax | LBW |
|---|---|---|---|---|---|
| Comparison | C-3 | S-2 | 0.19 | 680 | 90 |
| Comparison | C-6 | S-2 | 0.19 | 643 | 78 |
| Invention | IC-2 | S-2 | 0.19 | 620 | 56 |
| Invention | IC-3 | S-2 | 0.19 | 621 | 44 |
| Invention | IC-4 | S-2 | 0.19 | 631 | 56 |
| Invention | IC-7 | S-2 | 0.19 | 626 | 43 |
| Invention | IC-10 | S-2 | 0.39 | 624 | 54 |
| Invention | IC-13 | S-2 | 0.19 | 635 | 62 |
| Invention | IC-14 | S-2 | 0.19 | 634 | 64 |
| Invention | IC-15 | S-2 | 0.19 | 628 | 54 |

TABLE 3

Couplers Dispersed in Various Solvents

| Comparison or Invention | Coupler | Solvent | g Ag per m² | λmax | LBW |
|---|---|---|---|---|---|
| Comparison | C-1 | S-1 | 0.19 | 649 | 83 |
| Comparison | C-1 | S-4 | 0.19 | 666 | 91 |
| Comparison | C-3 | S-1 | 0.19 | 683 | 98 |
| Comparison | C-3 | S-2 | 0.19 | 680 | 98 |
| Invention | IC-3 | S-1 | 0.19 | 626 | 57 |
| Invention | IC-3 | S-2 | 0.19 | 622 | 47 |
| Invention | IC-3 | S-3 | 0.19 | 630 | 58 |
| Invention | IC-3 | S-4 | 0.19 | 626 | 56 |
| Invention | IC-3 | S-5 | 0.19 | 626 | 56 |

The data in Tables 1, 2 and 3 show that all of the cyan image couplers of the present invention form image dyes that are shifted hypsochromically and at the same time have spectra that are very sharp cutting on the short wavelength side of their absorption bands. These sharp-cutting absorption dye curves are indicated by the unusually smaller values for the left bandwidth (LBW) than those of the dyes from the comparison couplers. Thus the dyes from the couplers of our invention have less unwanted green and blue absorption than the dyes from the comparison couplers, resulting in superior color reproduction and high color saturation. Furthermore, this advantage is realized even when the couplers are dispersed in a wide variety of coupler solvents, indicating that the couplers of the present invention have great robustness.

Figure 2:
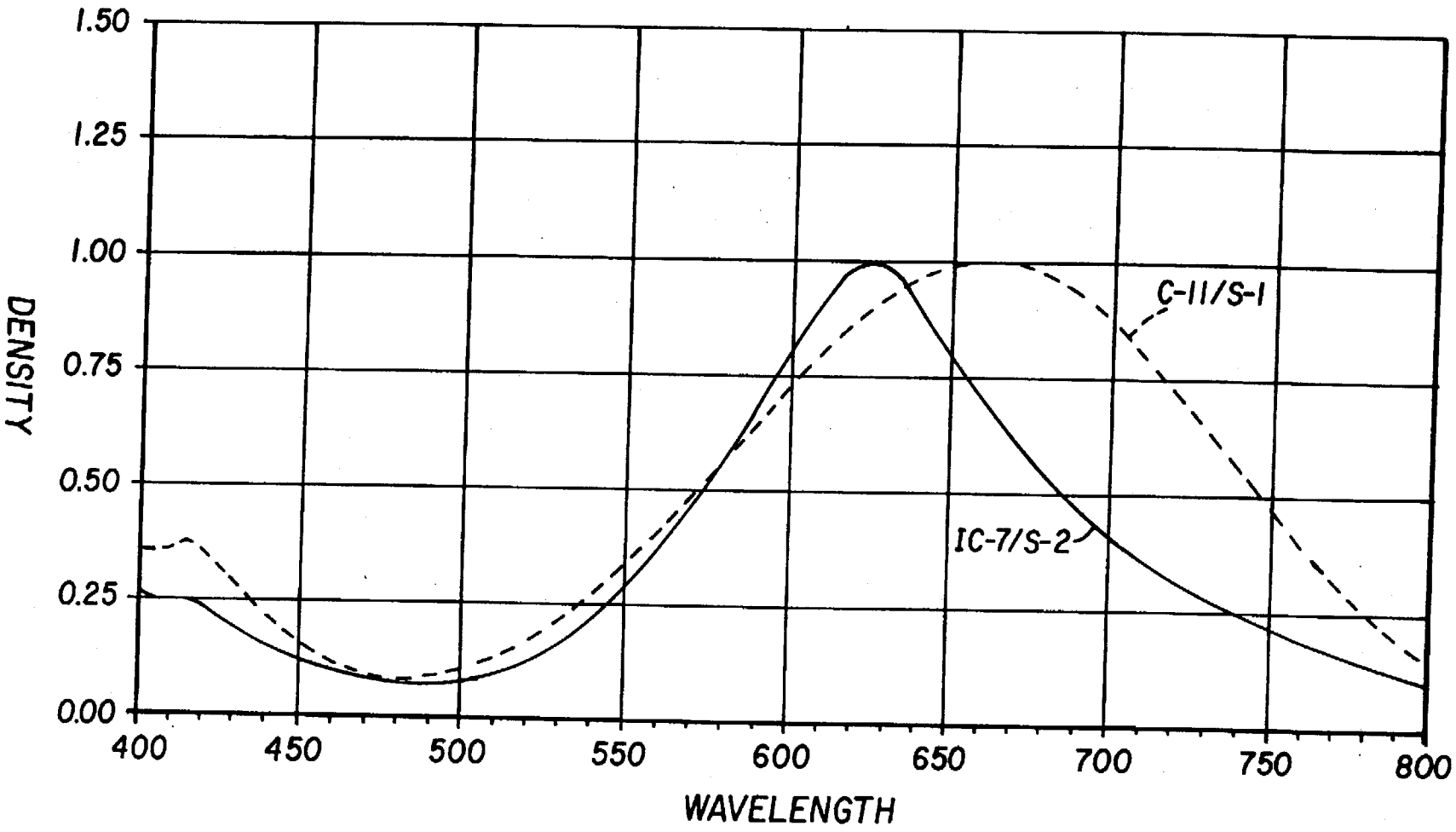
FIG. 2 shows the absorption spectra of the image dyes from coupler IC-7 in solvent S-2 (solid line) and coupler C-8 in solvent S-1 (broken line).

The superior hue of the dyes generated from the couplers of our invention are further illustrated in FIGS. 1 and 2. FIG. 1 compares the spectra of the dyes from coupler IC-3 of our invention and comparison coupler C-1, both dispersed in coupler solvent S-1. These two couplers both have sulfone-containing ballasts, but the ballast of coupler C-1 does not conform to the requirements of the invention. Thus it does not exhibit the desired hue advantages. FIG. 2 compares the dyes from coupler IC-7 of the invention dispersed in coupler solvent S-2, and comparison coupler C-8 dispersed in solvent S-1. Again, lower unwanted absorption is realized by the invention. The combination of coupler C-8 and solvent S-1 is used in most commercially available color photographic papers. In each of these comparisons, the coupler of our invention yields a dye which has significantly less unwanted absorption in the region of 400–585 nm, which encompasses nearly all of the blue and green regions of the visible spectrum.

The entire contents of the various patent applications, patents and other publications referred to in this specification are incorporated herein by reference.

What is claimed is:

1. A photographic color negative print element comprising a light sensitive silver chloride emulsion layer having associated therewith a cyan dye forming coupler having Formula (I):

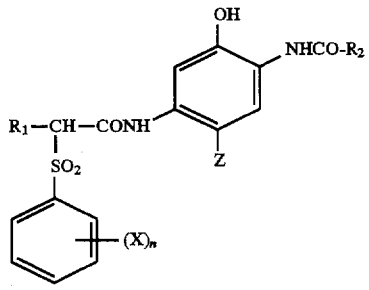

(I)

wherein $R_1$ represents hydrogen or a methyl, ethyl, n-propyl or isopropyl group;

$R_2$ represents an alkyl group or an aryl group;

n represents 1, 2, or 3;

each X is located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups; and Z represents a hydrogen atom or a group which can be split off by the reaction of the coupler with an oxidized color developing agent.

2. The element of claim 1 wherein $R_1$ is hydrogen.

3. The element of claim 1 wherein $R_1$ is a perfluorinated alkyl group.

4. The element of claim 1 wherein $R_2$ is a phenyl group.

5. The element of claim 4 wherein $R_2$ is a phenyl group substituted with a member selected from the group consisting of cyano, halogen, carbonyl, alkoxy, aryloxy, sulfonyl, oxysulfonyl, sulfoxide, thio, sulfamoyl, carboxy, sulfonamido, carbonamido, and carbamoyl groups.

6. The element of claim 1 wherein $R_2$ is an alkyl group.

7. The element of claim 6 wherein $R_2$ is a perfluorinated alkyl group.

8. The element of claim 6 wherein $R_2$ is an alkyl group substituted with a member selected from the group consisting of fluoro, chloro and aryl groups.

9. The element of claim 1 wherein $R_2$ is selected from the group consisting of a heptafluoropropyl, 4-chlorophenyl, 3,4-dichlorophenyl, 4-cyanophenyl, 3-chloro-4-cyanophenyl, pentafluorophenyl, 4-carbonamidophenyl, 4-sulfonamidophenyl, and an alkylsulfonyl group.

10. The element of claim 1 wherein at least one X is an alkyl group.

11. The element of claim 1 wherein at least one X is selected from the group consisting of alkyl, alkoxy, carboxy, sulfonamido, and halogen.

12. The element of claim 1 wherein Z is hydrogen.

13. The element of claim 1 wherein Z is bonded to the coupler by a heteroatom in Z.

14. The element of claim 13 wherein Z is selected from the group consisting of halogen, aryloxy, alkoxy, arylthio, alkylthio, and heterocyclic groups.

15. The element of claim 2 wherein $R_2$ is a phenyl group.

16. The element of claim 15 wherein at least one X is selected from the group consisting of alkyl, alkoxy, carboxy, sulfonamido, and halogen.

17. A process for forming an image in an element as described in claim 1 after the element has been imagewise exposed to light comprising contact the element with a color developing compound.

* * * * *